United States Patent [19]

Carter et al.

[11] 4,230,065

[45] Oct. 28, 1980

[54] APPARATUS FOR PRINTING AND PROTECTING INK INDICIA ON FRUITS

[75] Inventors: Ned C. Carter, Chino; Jerry W. Cramer, Upland; Dennis E. Bilton, Alta Loma, all of Calif.

[73] Assignee: Sunkist Growers, Inc., Sherman Oaks, Calif.

[21] Appl. No.: 929,264

[22] Filed: Jul. 31, 1978

[51] Int. Cl.[3] ..... B41F 17/34; B41F 35/00; B41F 31/20; B05B 13/2

[52] U.S. Cl. ..... 118/17; 101/37; 101/40; 118/24; 118/46; 118/326

[58] Field of Search ..... 118/DIG. 6, 46, 300, 118/24, 326; 101/35, 36, 37, 40

[56] References Cited

U.S. PATENT DOCUMENTS

| | | | |
|---|---|---|---|
| 1,198,610 | 9/1916 | Blakeslee | 118/300 |
| 1,685,392 | 9/1928 | Beadle | 118/DIG. 6 |
| 2,153,548 | 4/1939 | Della | 118/46 |
| 2,285,841 | 6/1942 | Sharma | 118/DIG. 6 |
| 2,987,991 | 6/1961 | Johnson | 101/376 |
| 3,381,610 | 5/1968 | Everingham | 101/35 |
| 3,603,249 | 9/1971 | Mumma | 101/35 |
| 3,800,702 | 4/1974 | Roberts | 101/425 |
| 3,896,730 | 7/1975 | Garrett | 101/425 |
| 3,952,654 | 4/1976 | Evans | 101/425 |

*Primary Examiner*—Clyde I. Coughenour
*Attorney, Agent, or Firm*—Paul A. Weilein

[57] ABSTRACT

Apparatus for printing an indicium on objects, fruits and the like with an ink which may or may not be water soluble, but which is preferably of a type which may be readily consumed by humans without damaging effect, the fruit being successively pre-oriented and delivered by a conveyor to a printing station where inked printing dies carried by a printing roller are utilized to apply the indicia, after which the fruit is then discharged from the conveyor in a free-fall trajectory path onto a receiver, an air-brush type nozzle being utilized to jet-spray the indicium with a quick drying sealant coating as the fruit is moved through the trajectory path. The spray nozzle is directed towards a collecting opening having a connection with a suction source. Also, a selector valve is provided to permit disconnection of the coating material supply to the nozzle, and connection of the nozzle to a supply of cleaning solvent.

3 Claims, 6 Drawing Figures

SOLVENT
SEALANT

APPARATUS FOR PRINTING AND PROTECTING INK INDICIA ON FRUITS

BACKGROUND OF THE INVENTION

It has heretofore been generally known in the food industry, and in particular in the citrus industry, to print or stamp identifying names as well as other indicia on objects, food products, citrus fruits and the like.

A variety of commercially available printing machines have been developed for commercial use, and by means of which the stamping or printing is made possible on a continuous high speed basis. For example, the machine as disclosed in the Johnson, Jr. et al U. S. Pat. No. 2,987,991 is characteristic, and is incorporated into the present disclosure by reference.

Briefly, the machine of this patent includes a continuous conveyor with a plurality of spaced rotatable rollers capable of orienting and aligning fruits, vegetables, or other ellipsoidally shaped articles or objects so that their long axes are parallel to the axes of the rollers. The conveyor conducts the fruits or objects successively to a position between a rotary printing drum and underlying rotary platens, where inked printing dies apply ink indicium to the fruit or objects, which are then moved through a delivery path to an appropriate receiver.

It has been discovered that the type of printing ink which is used is an important consideration, particularly due to the commercial handling methods in which citrus fruits are stored at low temperatures (40°-55° F.) and high humidity (90% RH). When such fruit is packed, transported and displayed, it is commonly subjected to both high and low temperatures. Thus, when the cold fruit is exposed to warm, moist air, its temperature is below the dew point, and water tends to collect on the surface of the fruit. This condition, which is described as "sweating", is a normal effect in the industry and may vary from a light film of moisture to more copious amounts of condensate. In order to cope with this condition, the printing inks commonly employed are of the water non-soluble type so that the printed indicia remains "fast" and does not run or smear under the above described conditions.

More recently, however, although many of the present inks are safe and acceptable in most countries, new and increasingly more stringent food laws have been enacted in certain localities of the world, which prohibit the use of such water non-soluble types of inks, and require that all substances applied to food items should, in general, be a food grade, that is, fit for human consumption. Since the previously used water non-soluble inks do not always qualify under the new food regulations, it has been necessary to formulate new stamping or printing ink.

In developing such an ink, it has been discovered that the only dyes that are presently available for the formulation of an acceptable ink have relatively high water solubility and low oil solubility characteristics. Such inks, therefore, present serious problems with respect to the attainment of a desired sufficiently high tinctorial strength and sweat resistance.

To overcome the above noted problems, the present invention proposes an improved printing concept in which an acceptable ink is utilized in the printing machine for the printing or stamping of the indicium on the fruit, and wherein the stamped fruit will be delivered via a delivery path to the receiver, and while the fruit is in such delivery path apply a quick drying, transparent protective sealed coating to the indicium area. In this manner, the ink indicium will be sealed so that it will not run or smear, when subjected to the moisture and sweat producing conditions, and will continue to remain clear and legible.

SUMMARY OF THE INVENTION

The present invention relates generally to improved apparatus for the high speed printing of indicium on objects, fruits and the like, and is more particularly concerned with an apparatus and method for the printing of the indicium with a food grade type of printing ink, and the provision of novel means for the application of a protective coating over the indicium area in order to prevent its running or smearing under moisture and sweat inducing conditions.

With the foregoing in mind, it is one object of the herein described invention to provide an improved printing apparatus and method for the application of ink indicium to objects, fruits and the like, and wherein the indicium area is protected by a sealant coating.

A further object is to provide improved fruit printing apparatus according to the foregoing object, in which the printed fruit is delivered through a free-fall trajectory path from a conducting conveyor to a receiver, and in which the protective sealant coating is applied by an air-brush nozzle while the fruit is in the delivery path.

Another object is to provide in apparatus for the printing of ink indicium on objects, such as fruits and the like, a unique air-brush nozzle arrangement in which the nozzle directs a jet spray across a path of movement of the printed fruit, and in a direction towards a collection opening connected with a suction collection system.

It is also an object to provide unique fruit printing apparatus in which an air-brush nozzle is utilized to apply a sealant coating over the printed indicium on each fruit, and in which a valve is operatively arranged for selectively connecting the air-brush nozzle with a supply source of sealant material, and a supply source of a cleaning solvent material.

Further objects and advantages of the invention will be brought out in the following part of the specification, wherein detailed description is for the purpose of fully disclosing a preferred embodiment of the invention without placing limitations thereon.

BRIEF DESCRIPTION OF THE DRAWINGS

Referring to the drawings, which are for illustrative purposes only.

DESCRIPTION OF A PREFERRED EMBODIMENT

Figure 1:
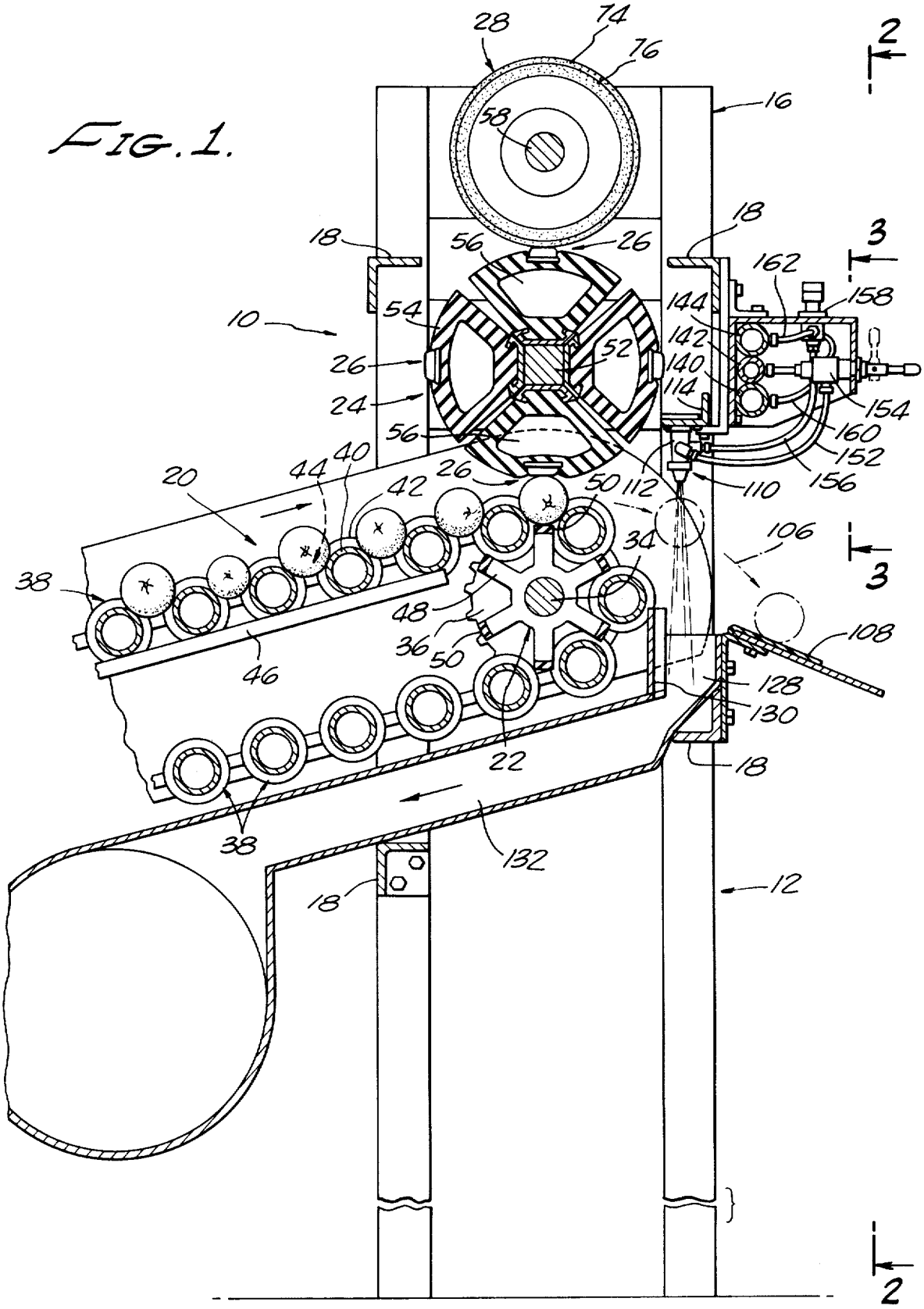
FIG. 1 is a fragmentary vertical sectional view of a printing machine embodying the features of the present invention, taken substantially on line 1—1 of FIG. 2.
Figure 2:
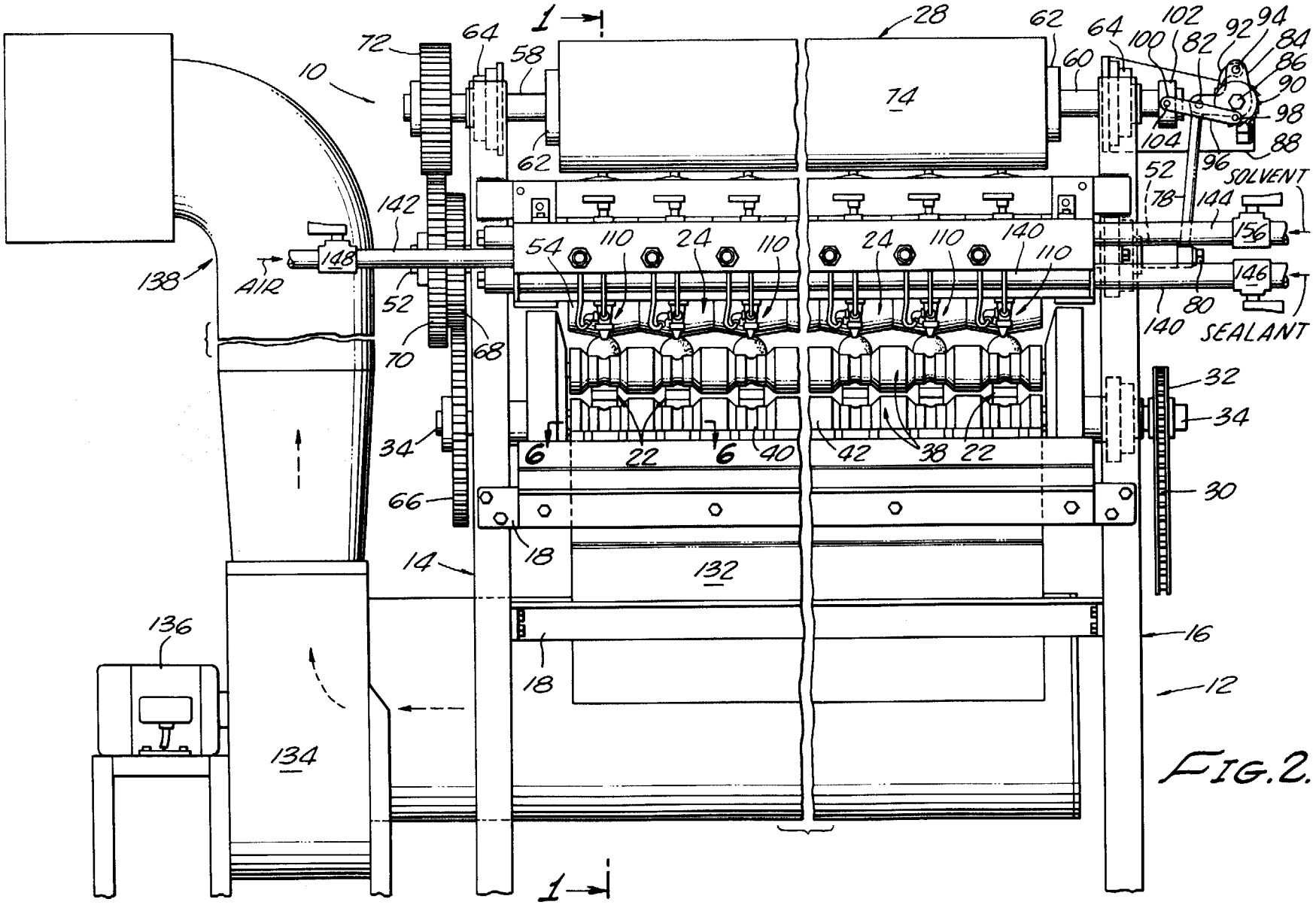
FIG. 2 is an end elevational view, as seen substantially along the line 2—2 of FIG. 1, and showing the arrangement of the air-brush nozzles for applying a sealant coating to the printed indicia areas.

Referring more specifically to the drawings, for illustrative purposes, the invention is shown in FIGS. 1 and 2 as comprising apparatus, as generally indicated by the numeral 10, for printing and protecting inked indicia an objects, such as fruits and the like, and in which the conveyor and printing components are substantially similar to those disclosed in the printing machine of the Johnson, Jr. et al U.S. Pat. No. 2,987,991.

More specifically in this respect, the components of the apparatus are supported upon a suitable frame structure 12 in which side frames 14 and 16 are interconnected by means of a plurality of cross members 18.

As will be seen in FIG. 1, an orienting conveyor 20 is arranged to carry the fruit or other objects to a printing station in which the fruit is moved between rotatably mounted platens 22 and a printing drum 24 having peripheral circumferentially spaced printing dies 26 that are moved thereby from an inking roller 28 into engagement with the successively delivered fruits. The conveyor, rotary platens, printing drum and inking roller are synchronously driven from a common power source (not shown) by means of a driving chain 30 which is trained over a main driving sprocket 32 on a main drive shaft 34.

Basically, the construction of the conveyor 20 is substantially similar to that disclosed in the above mentioned patent and briefly comprises a conveyor of the chain type in which conveyor side chains are longitudinally looped to form upper and lower runs, the side chains being trained at the opposite ends of the conveyor over supporting sprockets such as indicated at 36 at the delivery end of the conveyor, where the sprockets are mounted on the main drive shaft 34.

A plurality of rollers 38 are suitably rotatably supported at their ends upon the conveyor drive chains so as to be positioned in laterally spaced relation along the conveyor. Each roller 38 consists of an elongate cylinder 40 of suitable material, such as aluminum, upon which annular sleeves of trapezoidal longitudinal half-section and preferably of rubber are mounted in longitudinally spaced relation. The sleeves of adjacent rollers cooperate to form longitudinally aligned pockets 44 in which the individual fruits are supported and oriented by the rotation of the rollers as they are moved towards the printing station. As shown in FIG. 1, longitudinal roller actuating member 46 extends longitudinally beneath and contacts the cylinder portions 40 of the rollers 38 so as to rotate the rollers and orient the fruit as it is carried toward the printing station. The actuating member 46 terminates at a point spaced from the platens so that the rolls are not rotated by these members immediately prior to and during the printing operation.

Securely mounted upon the conveyor drive shaft 34 are a plurality of the rotary platens 22 (FIG. 1) having spokes 48 which extend between adjacent rollers and assist in supporting the fruit during the printing thereof. Preferably, these spokes extend into the pockets 44 between the rollers to the circle of revolution defined by the rotation of the axis of each of the rollers about the shaft 34. As shown, each spoke may be tipped with an end piece 50 of rubber or other flexible, resilient material in order to provide a yielding supporting surface for the fruit during the printing operation.

The printing drum 24 is mounted on a square shaft 52 which is appropriately journalled at its ends in the side frame 14 and 16. The printing dies 26 are respectively supported at the periphery of segmental die holders arranged as quadrants around the shaft 52. The die holders are constructed of rubber, sponge rubber, or other flexible resilient material, and are each formed with an internal cavity 56 to provide the requisite flexibility and resilient mounting for the printing die 26 mounted on its periphery.

The inking roller 28 for applying ink to the printing dies 26 is positioned above the printing drum 24 and is of cylindrical construction. The printing drum 28 is rotatably supported by stub shafts 58 and 60 secured to drum end plates 62 and rotatably journalled respectively in shaft bearings 64.

The conveyor, printing drum and inking roller are driven in synchronized times relationship through a gear chain arrangement in which a gear 66 secured to shaft 34 meshes with a gear 68 secured to the shaft 52. Another gear 70 which is also secured to the shaft 52 engages and drives gear 72 secured to the stub shaft 58 of the inking roller.

The printing drum and the means for its ink supply may vary in construction and operation. As herein disclosed, the printing drum is of a simple construction consisting of a cylindrical outer covering in the form of an outer sleeve 74 of a suitable fabric material for applying the printing ink to the engaged printing dies 26 as they are brought into engagement therewith by the rotation of the printing drum 24. Inwardly of the sleeve 74, there is provided an annular layer 76 of an appropriate material capable of storing a supply of ink and delivering it to the outer sleeve 74 during the operation of the apparatus.

As shown in FIG. 2, provision is made for longitudinally reciprocating the inking roller 28 during operation of the apparatus. Referring to FIG. 2, the mechanism for this purpose is shown as being associated with the stub shaft 60. The reciprocating mechanism is driven by a pitman 78 having a bearing connection at one end with a driving eccentric 80 at the outer end of the printing drum shaft 52. The other end of the pitman is pivotally secured by means of a pin 82 to a V-shaped pawl actuator 84 which is mounted on a pivot 86 secured to bracket 88 mounted on the side frame 16. A ratchet wheel 90 is also mounted upon the pivot 86 for rotation by means of pawl 92 pivoted at 94 to the pawl actuator 84 for engagement with the teeth of ratchet wheel 90. One end of a driving rod 96 is eccentrically connected to the ratchet wheel on pivot 98, while the other end in the form of a yoke 100 is pivoted to a thrust bushing 102 on the stub shaft 60 by means of a pin 104. With this arrangement, it will be apparent that upon rotation of the shaft 52, the pitman 78 will reciprocate and transmit motion to the pawl actuator. When the pitman moves upwardly, the pawl 92 will ride over the teeth of the ratchet wheel 90, and when it moves downwardly the pawl will engage the ratchet teeth and rotate the ratchet wheel in a manner to apply reciprocative movements to the inking roller.

As shown in FIG. 1, it will be seen that as each fruit is printed with the ink indicium, the movement of the orienting rollers around the support for the delivery end will cause the printed fruit to be forcibly thrown into a free-fall trajectory delivery path, as indicated by the arrows 106, onto a receiver 108 which may comprise a suitable cushion or pad.

As shown in FIG. 2, the rollers 38 of the conveyor will deliver parallel spaced apart rows of fruits to the printing station where the indicia are applied. A plurality of air-brush assemblies 110 are respectively aligned with the rows of delivered printed fruits at the delivery end of the conveyor for jet spraying a protective sealant over the ink indicia areas during the movement of the fruits in the delivery path As shown in FIG. 2, the rollers 38 of the conveyor will deliver parallel spaced apart rows of fruits to the printing station where the indicia are applied. A plurality of air-brush assemblies 110 are respectively aligned with the rows of delivered printed fruits at the delivery end of the conveyor for jet spraying a protective sealant over the ink indicia areas during the movement of the fruits in the delivery path from the conveyor to the receiver 108.

Figure 3:
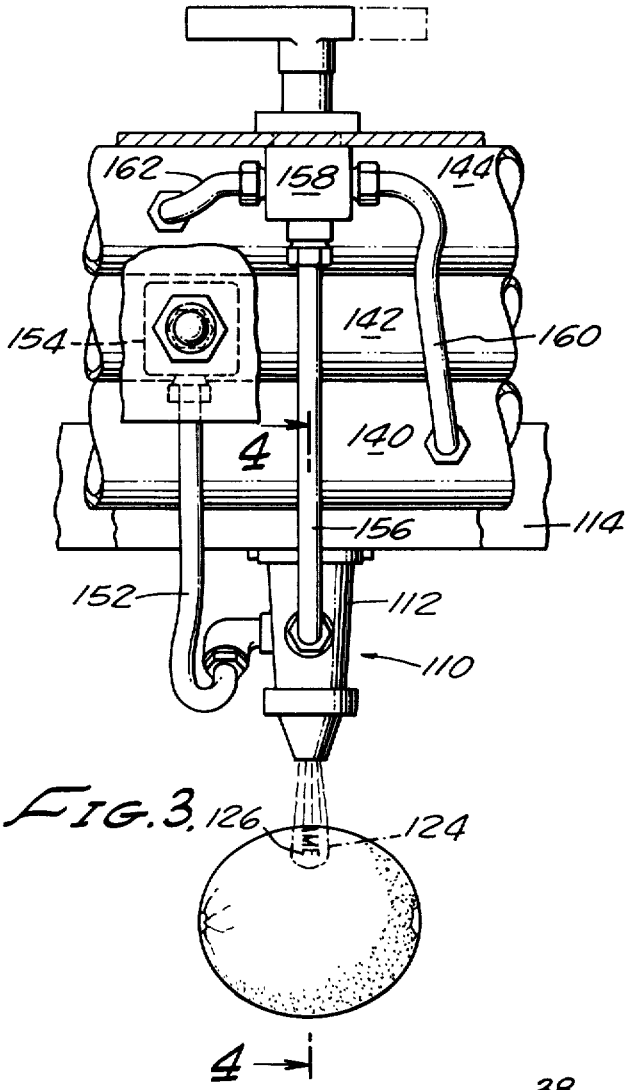
FIG. 3 is an enlarged fragmentary elevational view, partly in section, taken on line 3—3 of FIG. 1, and showing the details of the connections for the air, sealant material and cleaning solvent to each of the air-brush nozzles.
Figure 4:
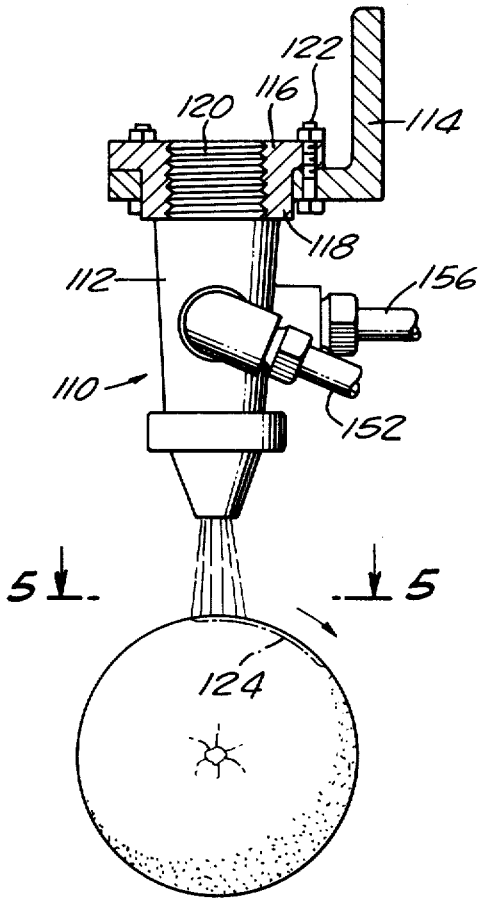
FIG. 4 is an enlarged fragmentary sectional view, taken substantially on line 4—4 of FIG. 3, showing the supporting arrangement for the air-brush nozzle.

As best shown in FIGS. 3 and 4, each air-brush assembly 110 comprises a nozzle 112 of the air-brush type, the nozzles being arranged for individual mounting upon a transversely extending frame cross member 114 by means of an individual mounting flange 116 with an internally threaded neck portion 118 for receiving a threaded end 120 of the nozzle. The mounting flange is removably attached to the cross member 114 by peripheral retaining bolt and nut fastening elements 122. As thus mounted, the nozzles are positioned above the trajectory paths of delivery of the fruits and have their nozzles directed downwardly so as to respectively deliver a spray jet of the sealant in a direction to form a sealant coating on each printed indicium while in the delivery path.

Figure 5:
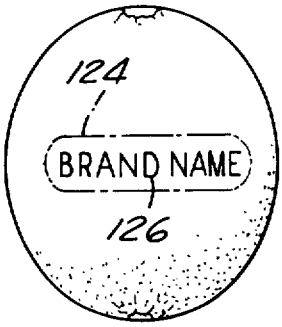
FIG. 5 is a top view of a fruit, as viewed along line 5—5 of FIG. 4, showing the path of movement of the applied jet spray of coating over the inked indicium area.

As shown in FIG. 5, the area size of the jet spray of sealant will be adjusted so as to be of a sufficient size, as indicated as 124, to progressively cover the indicium, such as the brand name as indicated at 126, or such other indicium as may be printed on the fruit.

Figure 6:
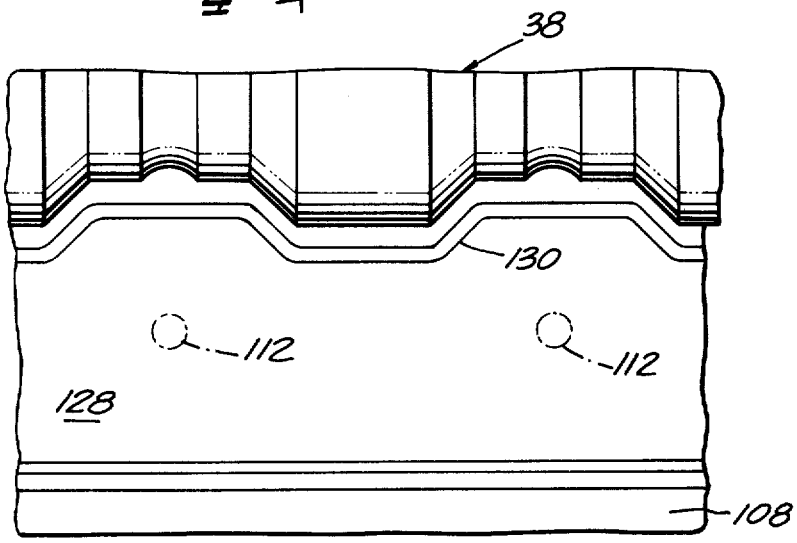
FIG. 6 is an enlarged fragmentary top view of the spray collecting basin for collecting the waste from the air-brush jet nozzles, as seen substantially along line 6—6 of FIG. 2.

As best shown in FIGS. 1 and 6, an upwardly opening catch basin 128 is positioned below the delivery trajectory paths of the fruits and extends transversely below the spray nozzles in a proper position to receive the unused sealant from the nozzles. As shown in FIG. 6, the inner wall 130 of the catch basin 128 is shaped to conform to the configuration of the external surface of the rollers 38 of the conveyor.

In FIG. 1, it will be seen that the catch basin 128 is in communication with a suction duct 132 which is connected with the intake of a suction fan 134 (FIG. 2) driven by an electric motor 136, the suction fan 134 being connected with an appropriate recovery and disposal system as generally indicated at 138.

Referring again to FIGS. 1, 2 and 3, three manifold pipes 140, 142 and 144 are supported on the frame structure and extend transversely between the side frames 14 and 16 above the row of nozzles 112. The manifold 140 is connected through a control valve 146 with a sealant source, the manifold 142 through a control valve 148 with a source of pressurized air, and the manifold 144 through a control valve 150 with a source of cleaning solvent.

As shown in FIG. 3, individual controls are provided for each of the nozzles 112. An air supply connection 152 connects the nozzle to manifold 142 through a control valve 154 which is utilized for starting up and shutting down the nozzle. A supply connection 156 for material to be sprayed through the nozzle is connected to the outlet of a selective valve 158, this valve being operable into one position in which the nozzle will be connected to the sealant manifold 140 through a connection 160, and in another position by a connection 162 with the cleaning solvent manifold 144. The valve 158 thus provides a flexibility of control which enables the nozzle to be quickly and easily connected to a source of cleaning solvent which may be carried through the nozzle for cleaning, whenever necessary.

From thc foregoing description and drawings, it will be clearly evident that the delineated objects and features of the invention will be accomplished.

Various modifications may suggest themselves to those skilled in the art without departing from the spirit of the disclosed invention and, hence, it is not wished to be restricted to the specific forms shown or uses mentioned, except to the extent indicated in the appended claims.

What is claimed is:

1. In apparatus for printing and protecting indicia on an object which apparatus includes a conveyor for conveying objects, said conveyor having a delivery end, a printing station through which said conveyor passes, a printing die at said printing station arranged to print indicia on the upper surface of said objects as they pass through said station and a receiver spaced from said delivery end, said conveyor being arranged to project said objects from said delivery end to said receiver in a free flight path across the space therebetween, said path having a substantial horizontal component, the improvement comprising:

a nozzle over said space and arranged to spray a quick drying transparent material downwardly transversely across said path onto the upper surface of objects projected along said path whereby said material does noot impinge on and contaminate either said conveyor or said receiver.

2. Apparatus as defined in claim 1 including a collection device below said space in a position to receive material sprayed from said nozzle, said collection device being connected to a source of suction.

3. Apparatus as defined in claim 1 including conduit means connecting said nozzle to a supply of said material to a source of cleaning solvent and to a source of pressurized air, and valve means in said conduit means for selectively supplying said nozzle with either said material or said cleaning solvent.

* * * * *